US008449323B2

(12) United States Patent
Omae et al.

(10) Patent No.: US 8,449,323 B2
(45) Date of Patent: May 28, 2013

(54) WATERTIGHT SHIELD CONNECTOR

(75) Inventors: Takashi Omae, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/379,380

(22) PCT Filed: Dec. 14, 2010

(86) PCT No.: PCT/JP2010/072459

§ 371 (c)(1), (2), (4) Date: Dec. 20, 2011

(87) PCT Pub. No.: WO2011/096135

PCT Pub. Date: Aug. 11, 2011

(65) Prior Publication Data

US 2012/0295479 A1 Nov. 22, 2012

(30) Foreign Application Priority Data

Feb. 2, 2010 (JP) ..... 2010-021194

(51) Int. Cl.
*H01R 13/648* (2006.01)

(52) U.S. Cl.
USPC ..... 439/559; 439/607.01; 439/607.35

(58) Field of Classification Search
USPC ..... 439/607.01, 607.35, 559, 548, 556
See application file for complete search history.

(56) References Cited

U.S. PATENT DOCUMENTS 6,280,208 B1 * 8/2001 Masuda et al. ..... 439/98
6,422,899 B1 * 7/2002 Miyazaki ..... 439/559
6,796,838 B2 * 9/2004 Yoshioka ..... 439/607.01
7,204,716 B1 4/2007 George et al.
7,828,591 B2 * 11/2010 Matsuoka ..... 439/559

(Continued)

FOREIGN PATENT DOCUMENTS

JP 2002-252057 A 9/2002
JP 2005-011646 A 1/2005
JP 2008-041600 A 2/2008

OTHER PUBLICATIONS

International Search Report for PCT/JP2010/072459 issued Jan. 18, 2011.

*Primary Examiner* — Gary F. Paumen

(74) *Attorney, Agent, or Firm* — Edwards Wildman Palmer LLP

(57) ABSTRACT

An object of the present invention is to provide a watertight shield connector able to waterproof successfully without an effect of a parting line, and surely preventing an annular packing or a shield shell from falling out with a plain structure. For attaining the object, there is provided a watertight shield connector 1 including: an insulating connector housing 4 having a terminal attaching portion 9 projected outward from a flange wall 2, and an annular hole 19 disposed around the terminal attaching portion 9; a terminal 10 configured to be inserted into the terminal attaching portion 9 and having a step portion 11*a* in a middle thereof; a conductive shield shell 6 having a flange plate 5 abutting on the flange wall 2; an annular packing 8 having an annular packing main body 30 attached to the annular hole 19, and a flange-shaped projection 7 disposed on an outer periphery of the packing main body 30 and abutting on the flange plate 5; and a spacer 12 configured to be engaged with the step portion of the terminal and to abut on an outer end wall 8*a* of the annular packing 8.

4 Claims, 4 Drawing Sheets

U.S. PATENT DOCUMENTS 8,187,030 B2 * 5/2012 Matsuoka et al. ..... 439/542
2002/0119690 A1 8/2002 Nakamura et al.
2011/0045693 A1 * 2/2011 Uchida ..... 439/567
2011/0230086 A1 * 9/2011 Fujiwara et al. ..... 439/559

* cited by examiner

WATERTIGHT SHIELD CONNECTOR

TECHNICAL FIELD

This invention relates to a watertight shield connector having a waterproof performance, and an electromagnetic shielding performance, and configured to be locked with a terminal and to be directly attached to an on-vehicle device or the like.

BACKGROUND ART

FIG. 7 shows one embodiment of a conventional watertight shield connector (see Patent Document 1).

This watertight shield connector 61 includes: an insulating resin-made connector housing 64 integrally having a flange 63 directly connected to an on-vehicle device 62 with a bolt; a male terminal 66 press-fitted into and fixed to a terminal receiving chamber 65 of the connector housing 64; a conductive metal-made shield shell 67 covering the terminal receiving chamber 65 and abutting on the device 62 along the flange 63; and a rubber-made annular packing 68 disposed on a peripheral groove of the flange 63 and closely abutting on the device 62.

FIG. 8 shows the other embodiment of the conventional watertight shield connector.

This watertight shield connector 71 includes: a connector housing 75 having a flange 72 and a tube 74 projected from a hole 73 of the flange 72 for inserting an electric wire with a terminal; a shield shell (shield terminal) 76 inserted into the hole 73 and fixed to the flange 72 with a bolt; and an annular packing 77 attached to the tube 74 and waterproofing the hole 73.

In Patent Document 2, it is described that a watertight connector (not shown) other than the above described connectors which is not a shield connector has an annular packing attached to an outer periphery of a terminal receiving chamber of a connector housing, and prevents the annular packing from falling out with a spacer for locking a terminal.

PRIOR ART DOCUMENT

Patent Document

Patent Document 1: JP, A, 2008-41600 (FIG. 13)
Patent Document 2: JP, A, 2002-252057 (FIG. 4)

DISCLOSURE OF THE INVENTION

Problem to be Solved by the Invention

However, in the conventional watertight shield connector 61 shown in FIG. 7 (Patent Document 1), there is a concern that the shield shell 67 may fall out of the connector housing 64 before the shield shell 67 is caught and fixed between the flange 63 and the device 62. For preventing this, locking members (not shown) are provided in the shield shell 67 and the connector housing 64, and there is a problem that a structure of the watertight shield connector becomes complex.

Further, in the watertight shield connector 71 shown in FIG. 8, when a projection 78 for locking the annular packing 77 is formed on the tube 74, a resin molding die is moved not only one direction but the other direction with a sliding mechanism or the like. Therefore, a parting line is generated on a sealing surface 74 in an axial direction, and there is a problem that waterproof sealing ability may be reduced. Further, for fixing the shield shell 76, a locking frame piece 79 is provided in the shield shell 76, and a hole 80 is provided on the flange 72 of the 75 connector housing 75 for inserting and locking the locking frame piece 79. Therefore, there is a problem that a fixing structure of the shield shell 76 becomes complex, and a cost of the shield shell 76 is increased.

Further, in the watertight shield connector described in the Patent Document 2, when the terminals or the like are electromagnetically shielded using the shield shell, a locking member is provided for preventing the shield shell from falling out similar to the above. Therefore, there is a problem that a structure of the watertight shield connector becomes complex.

In view of the above problems, an object of the present invention is to provide a watertight shield connector able to waterproof successfully without an effect of a parting line, and surely preventing an annular packing or a shield shell from falling out with a plain structure.

Means for Solving the Problem

For attaining the object, according to the invention described in claim 1, there is provided a watertight shield connector comprising:

an insulating connector housing having a flange wall, a terminal attaching portion projected outward from the flange wall, and an annular hole disposed around the terminal attaching portion;

a terminal configured to be inserted into the terminal attaching portion and having a step portion in a middle thereof;

a conductive shield shell having a flange plate abutting on the flange wall;

an annular packing having an annular packing main body attached to the annular hole, and a flange-shaped projection disposed on an outer periphery of the packing main body and abutting on the flange plate; and a spacer configured to be engaged with the step portion of the terminal and to abut on an outer end wall of the annular packing.

According to the above structure, the annular packing is attached to the outer periphery of the terminal attaching portion of the connector housing. An inner periphery of the annular packing closely abuts on the outer periphery of the terminal attaching portion. An outer periphery of the annular packing closely abuts on the inner periphery of the annular hole. The flange plate of the shield shell abuts on the flange wall of the connector housing (a shell main body is inserted into the annular hole). The flange-shaped projection disposed on the outer periphery of the annular packing abuts on the flange plate of the shield shell. The spacer locks the terminal and abuts on the outer end wall of the annular packing to prevent the annular packing from falling out. Further, the flange-shaped projection surely prevents the shield shell from falling out. A projection disposed on the outer periphery of the terminal attaching portion for preventing the annular packing from falling out is unnecessary. Further, a parting line due to the projection upon the resin mold is not generated.

According to the invention described in claim 2, there is provided the watertight shield connector as claimed in claim 1, wherein a frame wall for terminal insertion is provided in a projecting manner in a terminal guiding wall extended from the terminal attaching portion, wherein the spacer is inserted into a space between the terminal attaching portion and the frame wall, and the spacer abuts on an end wall of the frame wall.

According to the above structure, the terminal is inserted into the frame wall, and stably supported, and the spacer abuts on the end wall of the frame wall and is stably supported without falling down, thereby a locking performance of the terminal with the spacer is increased, and a falling-out prevention performance of the annular packing and the shield shell is increased.

According to the invention described in claim 3, there is provided the watertight shield connector as claimed in claim 1 or 2, wherein a projection of the spacer engaged with the step portion is extended to abut on an another outer end wall of the annular packing.

According to the above structure, two positions of the annular packing in a radial direction is stably supported by the two points of a main body of the spacer and an extended portion of the projection, thereby the falling-out prevention performance of the annular packing and the shield shell is increased.

Effects of the Invention

According to the invention claimed in claim 1, an engagement of the terminal and falling-out prevention are simultaneously performed by the spacer, and the flange-shaped projection of the annular packing which is prevented from falling out by the spacer surely prevents the shield shell from falling out. Therefore, a member for preventing the annular packing from falling out and a member for preventing the shield shell from falling out are unnecessary, thereby a structure of the watertight shield connector is simplified, and a cost of the watertight shield connector is reduced. Further, because a conventional projection for preventing the annular packing from falling out is unnecessary, a parting line upon resin mold due to the projection is not generated, and a reduction of the seal ability due to the parting line is prevented, thereby good seal ability is maintained.

According to the invention claimed in claim 2, because the end wall of the frame wall of the terminal guiding wall stably supports the spacer without falling down, the locking of the terminal and the falling-out prevention are further surely performed by the spacer.

According to the invention claimed in claim 3, two positions of the annular packing in a radial direction is stably supported by the two points of a main body of the spacer and an extended portion of the projection, thereby the falling-out prevention of the annular packing and the shield shell is further surely performed.

DESCRIPTION OF EMBODIMENTS

Figure 1:
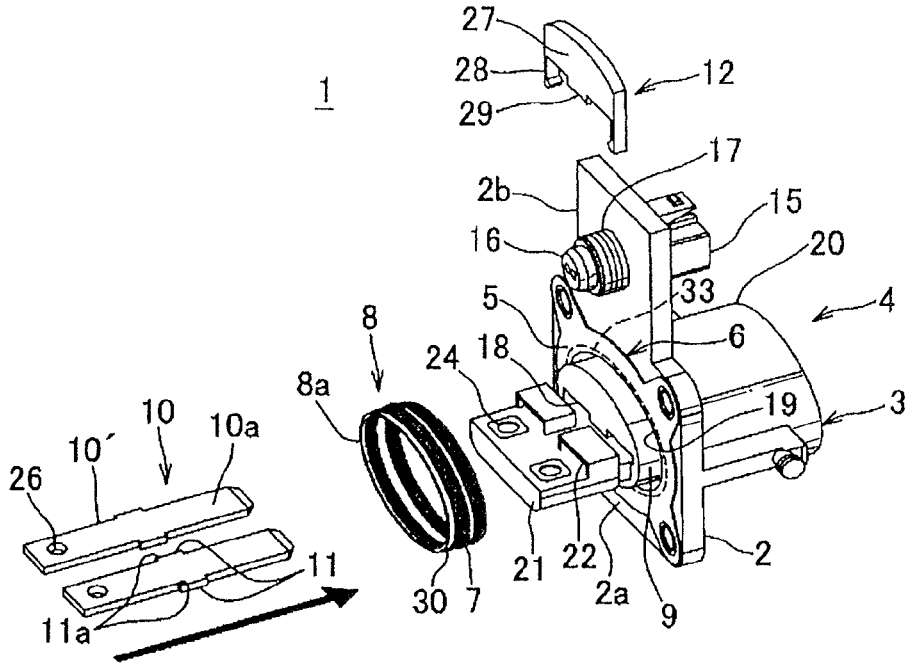
[FIG. 1] An exploded perspective view showing an embodiment of a watertight shield connector according to the present invention.

FIG. 1 shows an embodiment of a watertight shield connector according to the present invention.

This watertight shield connector 1 includes: an insulating-resin-made connector housing 4 composed of a flange wall 2 and a housing main body 3; a conductive-metal-made shield shell (shield terminal) 6 attached to an inside of the housing main body 3 by abutting a flange plate 5 on the flange wall 2; a synthetic-resin-made annular packing 8 attached to an outer peripheral wall of a terminal attaching portion 9 of the housing main body 3 while abutting an intermediate flange-shaped projection 7 on the flange plate 5; a male terminal 10 attached to an inside of the terminal attaching portion 9; and an insulating-resin-made spacer 12 for locking an intermediate step portion 11*a* of the male terminal 10 and a rear end wall (outer end wall) 8*a* of the annular packing 8.

The flange wall 2 of the connector housing 4 is composed of a rectangular portion 2*a* and an extended portion 2*b* extended from the rectangular portion 2*a*. Bolt insertion holes (not shown) are provided on four corners of the rectangular portion 2*a*. The flange wall 2 is fastened and fixed to an outer wall of a device (not shown) of a vehicle together with the flange wall 5 of the shield shell 6. A small housing 15 is provided on the extended portion 2*b*. An electric wire (not shown) continued to a small terminal in the small housing is guided outside via a tube portion 16 having no projection (no parting line). A small packing 17 is attached to an inside of a hole of the extended portion 2*b* along the tube portion 16. Because a structure at the small housing side is not a main part of the present invention, the structure is illustrated by an example.

The terminal attaching portion (inner housing) 9 of the housing main body 3 is formed in an oval shape, and has a plurality of (two in this embodiment) terminal insertion holes 18 arranged parallel to each other. A rear end of the terminal attaching portion 9 is projected backward from the flange wall 2. An annular hole 19 for inserting the shield shell 6 is provided outside the terminal attaching portion 9 and extended from a rear end of the flange wall 2 to an inside of the housing main body 3. A hood portion (outer housing) 20 is provided on an outside of the annular hole 19. The hood portion 20 is arranged perpendicular to the flange wall 2, and formed integrally with the flange wall 2. The terminal attaching portion 9 is formed integrally with the hood portion 20 by a joint portion (not shown) arranged radially.

A front half (electric contact portion) of the male terminal 10 is projected in the hood portion 20 to form a connector fitting chamber (not shown) for mating with a mating connector (not shown) having a female terminal. To fit to the mating connector is performed by a lever (not shown) with a low insertion force.

Figure 2:
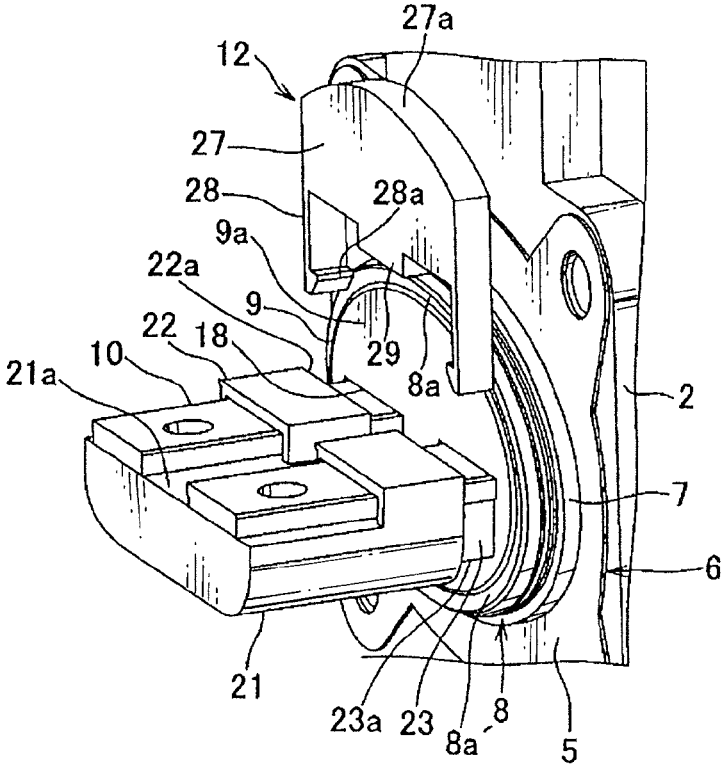
[FIG. 2] An exploded perspective view showing a main part of the same watertight shield connector during assembling.

An outer peripheral wall of the terminal attaching portion 9 is formed smoothly by extracting a resin mold die in one (front-back) direction without generating a parting line. As shown in FIG. 2, an inner peripheral wall of the annular packing 8 is closely fitted to the outer peripheral wall of the rear end of the terminal attaching portion 9 to surely perform watertight sealing ability.

As shown in FIGS. 1 and 2, a horizontal plate-shaped terminal guiding wall 21 is formed integrally and projectingly (extendedly) on a rear bottom half of the terminal attaching portion 9. Rear openings of the terminal insertion holes 18 are arranged along an upper wall 21*a* of the terminal guiding wall 21. A pair of left and right frame walls 22 is integrally projected from the upper wall 21*a* of the terminal guiding wall 21. A pair of left and right guiding grooves 23 for inserting the spacer 12 is provided at a root of the terminal guiding wall 21 in between a front end wall (end wall) 22*a* of the frame wall 22 and a rear end wall 9*a* of the terminal attaching portion 9. A pair of left and right nuts 24 for fixing the terminals is provided in the holes at a back of the frame wall 22.

As shown in FIG. 1, a pair of left and right male terminals 10 is provided, and includes: a horizontal plate portion 10'; projections 11 integrally provided at left and right in a middle of the male terminal 10 in a longitudinal direction and having step portions back and forth; and a bolt insertion hole 26 for fixing at a rear end side of the plate portion 10'. A hole in the frame wall 22 and the rear opening of the terminal insertion hole 18 are a little bit wider than a width between the left and right projections 11 of the male terminal 10.

As shown in FIGS. 1 and 2, the spacer 12 is composed of a vertical plate portion (main body) 27, a pair of flexible locking arms 28 projected downward from both left and right sides of the plate portion 27, and a rectangular projection 29 projected downward from a center bottom end of the plate portion 27. An upper end wall 27*a* of the plate portion 27 is formed in an arc shape along an outer periphery of the annular packing 8. Each locking arm 28 includes a claw portion 28*a* projecting inward and having a triangular sectional shape at a tip end of the locking arm 28. The claw portion 28*a* includes: an upper horizontal locking wall; and a lower sloped guiding wall. Incidentally, in the description, upper, lower, left and right directions are expediential for an explanation, and it is not necessary to fit an attaching direction of the watertight shield connector 1.

Figure 3A:
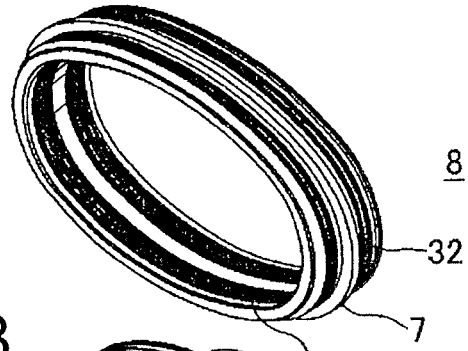
[FIG. 3A] A perspective view showing an embodiment of an annular packing.
Figure 3B:
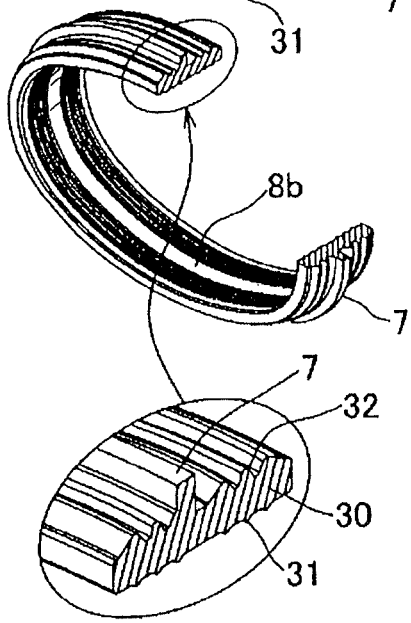
[FIG. 3B] A partially notched perspective view showing the embodiment of the annular packing (an enlarged view within a circle).

As shown in FIGS. 3A and 3B, the annular packing 8 includes: a packing main body 30 having a flat section; a plurality of small lips 31 provided parallel to each other on an inner peripheral wall of the packing main body 30; a plurality of large lips 32 provided parallel to each other on an outer peripheral wall of the packing main body 30; and a flange-shaped projection 7 integrally provided on the outer peripheral wall of the packing main body 30 at the center in a width direction. The center of the inner peripheral wall 8*b* inside the flange-shaped projection 7 is formed in a flat shape without a lip. The flange-shaped projection 7 is projected higher than the large lips 32 on the outer peripheral wall.

Figure 4:
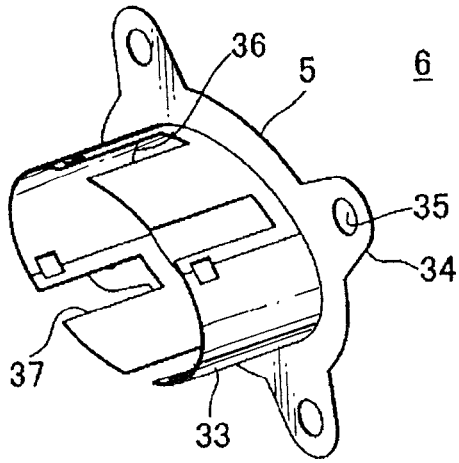
[FIG. 4] A perspective front view showing an embodiment of a shield shell.

As shown in FIG. 4, the shield shell 6 includes: an oval shaped flange plate 5; a shell main body 33 integrally provided perpendicular to the flange plate 5 and having an oval cross section. The flange plate 5 includes: pairs of upper and lower projections 34 and bolt insertion holes 35 at both left and right sides; and an oval shaped hole 36 communicating with an inner space of the shell main body 33. The shell main body 33 includes: a plurality of slits 37 up and down. The slits 37 are inserted into and engaged with joint portions (not show) connecting the terminal attaching portion 9 of the connector housing 4 with the hood portion 20. The flange plate 5 contacts a conductive-metal-made device to be grounded.

As shown in FIG. 1, the shell main body 33 of the shield shell 6 is inserted along an inner peripheral wall of the hood portion 20 having a gap between the shell main body 33 and the outer peripheral wall of the terminal attaching portion 9 of the connector housing 4, and the flange plate 5 abuts on the rear end wall of the flange wall 2. In FIG. 1, a front half of the annular packing 8 (a portion before the flange-shaped projection 7) is inserted into the annular hole 19 along the outer peripheral wall of the terminal attaching portion 9. Then, the small lips 31 (FIG. 3) provided on an front half of the inner peripheral wall are closely attached to the outer peripheral wall of the terminal attaching portion 9, and the large lips 32 provided on a front half of the outer peripheral wall are closely attached to the inner peripheral wall of the shell main body 33 of the shield shell 6.

As shown in FIG. 2, a vertical front end wall of the flange-shaped projection 7 of the annular packing 8 abuts on and is closely attached to the rear wall of the flange plate 5 of the shield shell 6, and further insertion of the annular packing 8 is prevented. The rear end wall 8*a* of the annular packing 8 is positioned substantially the same plane as the rear end wall 9*a* of the terminal attaching portion 9. The small lips 31 provided on a rear half of the inner peripheral wall of the annular packing 8 are closely attached to the outer peripheral wall of the terminal attaching portion 9, and the large lips 32 provided on a rear half of the outer peripheral wall are closely attached to an inner peripheral wall of a hole of a device (not shown). The watertight performance is accomplished by close attachments of the lips 31, 32, and the shield shell 6 is prevented from falling out backward by the flange-shaped projection 7 abutting on the flange plate 5.

Therefore, it is unnecessary to provide a locking member such as a locking claw on the shield shell 6. If the locking member is provided, when the locking member is unlocked by a vibration of a vehicle, the shield shell 6 is surely prevented from falling out by the flange plate 5 abutting on the flange-shaped projection 7.

As shown in FIG. 2, the pair of left and right male terminal 10 is inserted into the terminal insertion holes 18 of the terminal attaching portion 9 via the frame walls 22 along the terminal guiding wall 21. The left and right projections 11 of the male terminal 10 is inserted into the terminal attaching portion 9 via the frame wall 22 and the rear opening of the terminal insertion hole 18. A rear end of the male terminal 10 is positioned at the same plane as the rear end wall of the terminal guiding wall 21. The hole 26 of the male terminal 10 is coaxial with the nut 24 (FIG. 1) in the hole of the terminal guiding wall 21.

Next, the spacer 12 is inserted downward from a top along the rear end wall 9*a* of the terminal attaching portion 9. The locking arms 28 are bent outward while engaging along the guiding grooves 23, and when restoring, the claw portions 28*a* are engaged with lower end walls 23*a* of the guiding grooves 23. The lower end walls 23*a* are positioned higher than a lower wall of the terminal guiding wall 21. At the same time, the projection 29 at the center of the spacer 12 is inserted into between the left and right male terminals 10, and engaged, with a space between the front end walls 22*a* of the left and right frame walls 22 and the rear end wall 9*a* of the terminal attaching portion 9 (See FIG. 5). As shown in FIG. 6, a front end wall 12*a* of the spacer 12 abuts on both the rear end wall 9*a* of the terminal attaching portion 9 and the rear end wall 8*a* of the annular packing 8.

Figure 5:
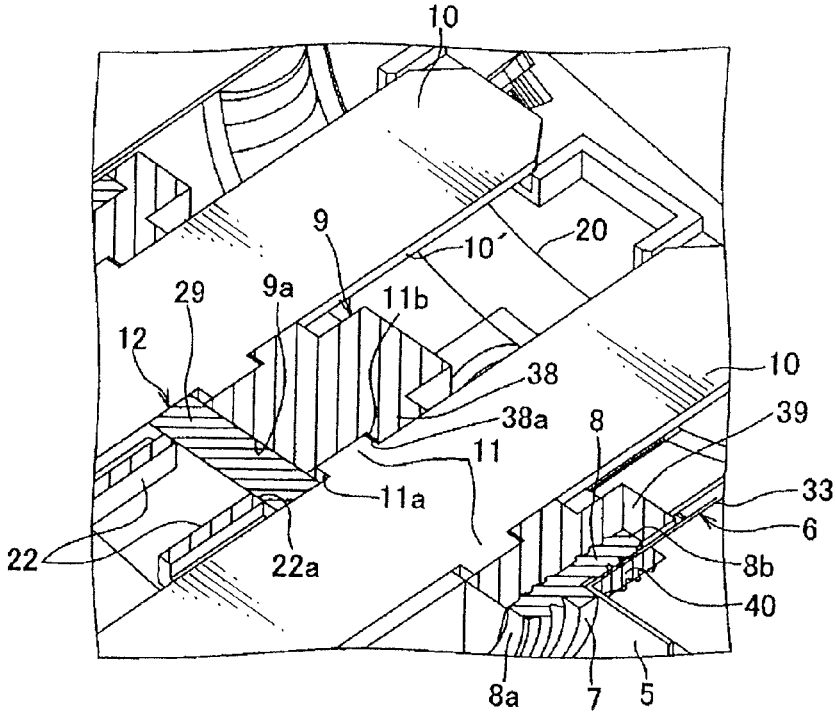
[FIG. 5] A lateral sectional perspective view showing a main part of the watertight shield connector in an assembling state.
Figure 6:
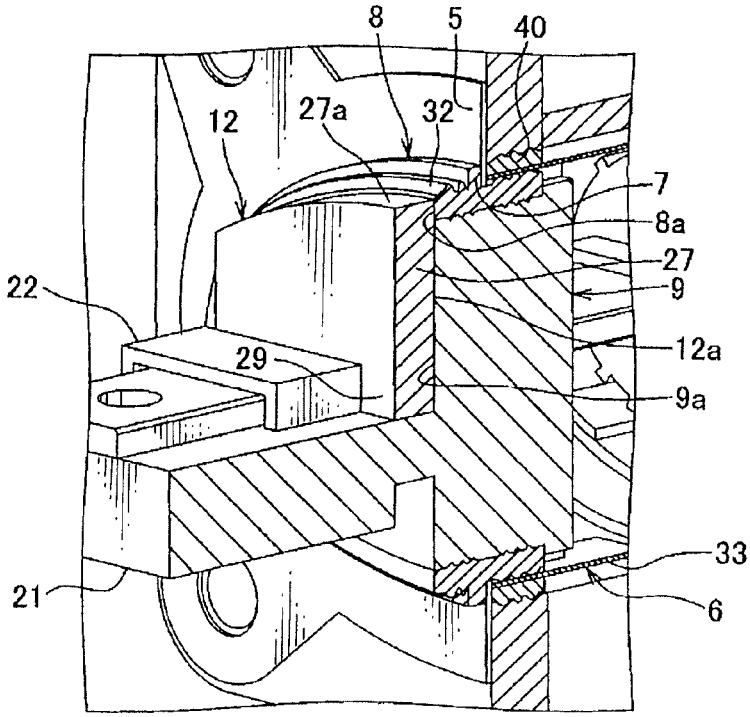
[FIG. 6] A vertical sectional perspective view showing the main part of the watertight shield connector in the assembling state.
Figure 7:
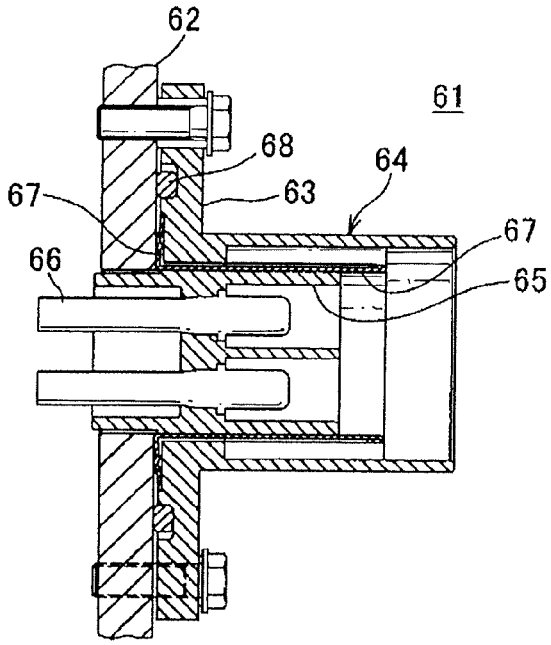
FIG. 7 PRIOR ART
[FIG. 7] A vertical sectional view showing one embodiment of a conventional watertight shield connector.
Figure 8:
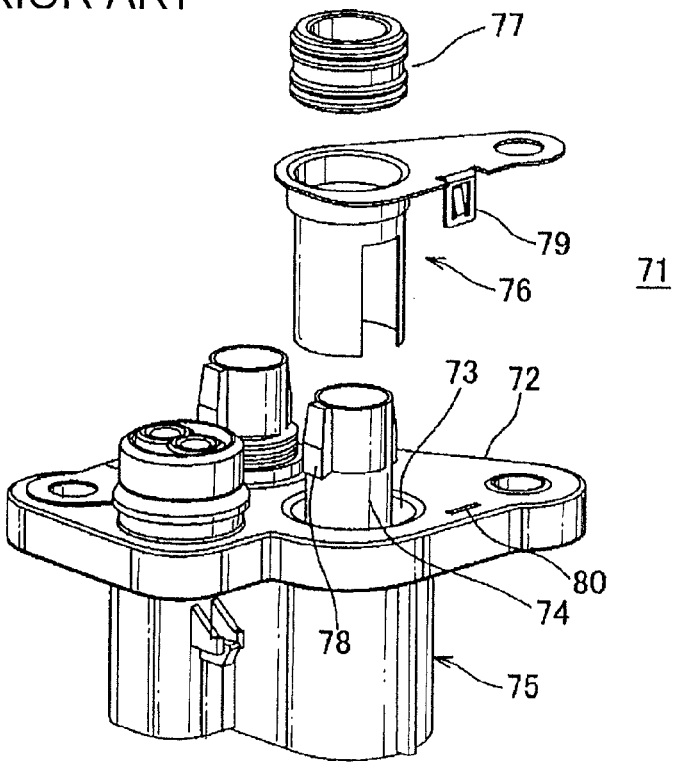
FIG. 8 PRIOR ART
[FIG. 8] An exploded perspective view showing the other embodiment of the conventional watertight shield connector.

As shown in FIG. 5, a projection (step portion) 38 is provided in the middle of each terminal insertion hole 18 (FIG. 2) of the terminal attaching portion 9. A front end wall 11*b* of the projection 11 of each male terminal 10 abuts on a rear end wall 38*a* of the projection 38, and a further insertion of the male terminal 10 is prevented. A width between the left and right projections 38 is a little narrower than a width of the plate portion 10' of the male terminal 10 so that the male terminal 10 is press-inserted and fixed between the projections 38. A front end wall 8*b* of the annular packing 8 abuts on a rear end wall of a flange portion 39 projected outward from a front end of the terminal attaching portion 9, and is stopped. In FIG. 5, reference sign 20 indicates the hood portion, 8 indicates the annular packing, 6 indicates the shield shell, and

40 indicates an annular small packing provided on an outside of the shield shell 6 and closely attached to a mating connector.

The projections 11 of the left and right male terminals 10 are locked on the center projection 29 to prevent the male terminals 10 from falling out backward. At the same time, as shown in FIG. 6, the front end wall 12*a* of the upper end wall 27*a* of the plate portion 27 of the spacer 12 abuts on the upper rear end wall 8*a* of the annular packing 8 to prevent the annular packing 8 from falling out backward with the spacer 12, and the flange-shaped projection 7 of the annular packing 8 which is pressed by the spacer 12 (prevented from falling out) abuts on the rear end wall of the flange plate 5 of the shield shell 6 to surely prevent the shield shell 6 from falling out backward.

The frame wall 22 together with the guiding groove 23 (FIG. 2) supports the spacer 12 vertically to prevent the spacer 12 from falling down, and to make the spacer 12 surely press the annular packing 8. Because the large lips 32 provided on the outer peripheral wall of the annular packing 8 are projected higher (outward in a radial direction) than the upper end wall 27*a* of the spacer 12, there is no fear to interfere with the spacer 12 when the rear half of the annular packing 8 is inserted into a hole of a device (not shown).

Incidentally, in the above-described embodiment, the male terminal 10 is used. When a female terminal (female type electric contact portion is provided on the front half of the plate portion 10') is used instead of the male terminal 10, the terminal insertion hole 18 of the terminal attaching portion 9 of the connector housing 4 and the frame wall 22 are formed wider in a vertical direction, the terminal attaching portion 9 is extended forward to make a terminal receiving chamber, the tubular shell main body 33 of the shield shell 6 is arranged along the outer peripheral wall of the terminal attaching portion 9, and the hood portion 20 is eliminated.

Further, in the above-described embodiment, projections 11 are provided on the male terminal 10 to form step portions. However, it is also possible to provide a concave portion (not shown) as a step portion instead of the projections 11, and to engage the projection 29 of the spacer 12 with the concave portion. In this case, inner widths of the frame wall 22 and the terminal insertion hole 18 are a little bit smaller than a width of the male terminal 10.

Further, in the above-described embodiment, the spacer 12 abuts and is locked on only the upper rear end wall (outer end wall) 8*a* of the annular packing 8. However, it is also possible to extend downward the center projection 29 of the spacer 12, to provide a through hole (not shown) on the terminal guiding wall 21 through which the extended projection (29) penetrates, and to abut and lock on the lower (other) rear end wall (outer end wall) 8*a'* of the annular packing 8 with a tip end of the extended projection (29) (to simultaneously press upper and lower portions in 180 degree direction of the annular packing 8 with the spacer 12).

INDUSTRIAL APPLICABILITY

The watertight shield connector according to the present invention can be used to surely make a connector for directly attaching a device to such as a vehicle watertight, to simplify a locking mechanism of a watertight annular packing with a shield shell for electromagnetic shield and to reduce cost of the watertight shield connector.

REFERENCE SIGNS LIST

1 watertight shield connector
2 flange wall
4 connector housing
5 flange plate
6 shield shell
7 flange-shaped projection
8 annular packing
8*a* rear end wall (outer end wall)
8*b* the other rear end wall (outer end wall)
9 terminal attaching portion
10 male terminal (terminal)
11*a* step portion
12 spacer
19 annular hole
21 terminal guiding wall
22 frame wall
22*a* end wall
projection
packing main body

The invention claimed is:

1. A watertight shield connector comprising:

an insulating connector housing having a flange wall, a terminal attaching portion projected outward from the flange wall, and an annular hole disposed around the terminal attaching portion;

a terminal configured to be inserted into the terminal attaching portion and having a step portion in a middle thereof;

a conductive shield shell having a flange plate abutting on the flange wall;

an annular packing having an annular packing main body attached to the annular hole, and a flange-shaped projection disposed on an outer periphery of the packing main body and abutting on the flange plate; and a spacer configured to be engaged with the step portion of the terminal and to abut on an outer end wall of the annular packing.

2. The watertight shield connector as claimed in claim 1, wherein a frame wall for terminal insertion is provided in a projecting manner in a terminal guide wall extended from the terminal attaching portion, and wherein the spacer is inserted into a space between the terminal attaching portion and the frame wall, and the spacer abuts on an end wall of the frame wall.

3. The watertight shield connector as claimed in claim 1, wherein a projection of the spacer engaged with the step portion is extended to abut on an another outer end wall of the annular packing.

4. The watertight shield connector as claimed in claim 2, wherein a projection of the spacer engaged with the step portion is extended to abut on an another outer end wall of the annular packing.

* * * * *